US008863639B2

(12) United States Patent
Gomez

(10) Patent No.: US 8,863,639 B2
(45) Date of Patent: Oct. 21, 2014

(54) ADJUSTABLE GAS BLOCK FOR A GAS OPERATED FIREARM

(75) Inventor: Jesus S. Gomez, Trappe, MD (US)

(73) Assignee: LWRC International LLC, Cambridge, MD (US)

( * ) Notice: Subject to any disclaimer, the term of this patent is extended or adjusted under 35 U.S.C. 154(b) by 0 days.

(21) Appl. No.: 13/593,021

(22) Filed: Aug. 23, 2012

(65) Prior Publication Data

US 2014/0083286 A1 Mar. 27, 2014

(51) Int. Cl.
*F41A 5/18* (2006.01)

(52) U.S. Cl.
CPC ..... *F41A 5/18* (2013.01)
USPC ..... 89/193; 89/191.01

(58) Field of Classification Search
CPC ..... F41A 5/28; F41A 5/18; F41A 5/26
USPC ..... 89/191.01, 191.02, 193
See application file for complete search history.

(56) References Cited

U.S. PATENT DOCUMENTS

| | | | | |
|---|---|---|---|---|
| 2,748,662 | A * | 6/1956 | Simpson | 89/193 |
| 7,856,917 | B2 * | 12/2010 | Noveske | 89/193 |
| 8,607,688 | B2 * | 12/2013 | Cassels | 89/193 |
| 2010/0218671 | A1 * | 9/2010 | Mayberry et al. | 89/192 |

* cited by examiner

*Primary Examiner* — Bret Hayes
*Assistant Examiner* — Joshua Freeman
(74) *Attorney, Agent, or Firm* — Porzio, Bromberg & Newman P.C.

(57) ABSTRACT

An adjustable gas block for a gas operated firearm offering a means to adjust a volume of gas directed to the host rifle's operating system. The adjustable gas block provides two positions of adjustment that are selectable based on the presence of a pressure increasing device being mounted on the firearm. A first position provides an optimal volume of gas into the gas operating system absent a back pressure increasing device. A second position usable in the presence of a back pressure increasing device causing venting of a portion of the volume of gas into a secondary chamber prior to release into the atmosphere. The amount of gas received by the operating system due to venting is reduced to a volume that is substantially equal to the volume of gas that would be received by the operating system absent a back pressure increasing device.

14 Claims, 9 Drawing Sheets

ADJUSTABLE GAS BLOCK FOR A GAS OPERATED FIREARM

BACKGROUND OF THE INVENTION

1. Field of Invention

This present invention generally relates to autoloading firearms, specifically to gas blocks for autoloading firearms which facilitate user adjustment to change the volume of gas that flows between the barrel and the operating system.

2. Description of the Related Art

The need to regulate the flow of gas between the barrel and operating system of a firearm has been a concern since the invention of autoloading firearms. Gas is generated during the combustion of gun powder present in the cartridges used in firearms. This gas expands violently to push the bullet out of the firearm's barrel. These expanding gases are also utilized as a means to operate the action of the host firearm. In modern firearms, the preferred method of facilitating the function of an autoloading weapon is as follows. A hole, or gas port, is placed through the barrel, generally on the top. Location of the gas port varies between operating systems and gas port size is chosen to allow a broad range of ammunition to be utilized while guaranteeing the reliable function of the host firearm. Unfortunately, due to varying lengths of barrels, ammunition variance, and other factors, it is very difficult to choose a gas port size which universally works under all conditions. A popular way of compensating for these problems is to incorporate an adjustable gas block into the operating system.

Traditionally, adjustable gas blocks have been used with autoloading rifles as a means to collect, restrict, and direct the flow of gas from the barrel into the gas operating system. By controlling the amount of gas directed into the operating system, reliable operation of the host firearm is ensured while also ensuring that recoiling parts are not actuated with undue force resulting in malfunctions or premature wear and breakage of parts.

In response to military request and an increased interest in both civilian and police markets, recent firearm designs have incorporated adjustable gas blocks designed to be used in conjunction with noise suppressors or silencers. Noise suppressors provide a means to redirect and expand the gases generated from the discharge of a firearm so that the resulting flash and sound generated by the firearm is minimized or eliminated. As a result, back pressure is generated, forcing more gas into the firearm's operating system. This extra gas, or back pressure, increases the firing rate of a weapon when operating at full auto, fouls the weapon leading to premature malfunction, can cause a variety of feeding and extraction problems, and causes premature wear on the reciprocating parts of the operating system. As a result, regulating the flow of gas into a firearm's operating system and optimizing that flow for use with and without a noise suppressor has become a primary purpose of modern adjustable gas blocks.

Prior art adjustable gas blocks can, in general, be characterized by the design disclosed in U.S. Pat. No. 2,748,662. Common in the prior art is the use of an oversized gas port located on the barrel which is in communication with the gas block and gas operating system of the host firearm. The adjustable gas block is provided with an indexing means that also turns a gas cylinder, or analogous structure. The gas cylinder has a series of openings, or ports, of differing size such that, when different ports are aligned with the port of the barrel, the flow of gas from the barrel into the operating system is thereby regulated. By rotating the gas cylinder with the provided indexing means, the user is able to select the most appropriate gas flow setting based on the ammunition being used, use of a rifle grenade or the presence of a noise suppressor.

Prior art designs typically rely on the use of tools to adjust the position of the gas cylinder, an inconvenient requirement for civilian, law enforcement and military users alike. Further, many prior art designs are subject to carbon build up between the rotating gas cylinder and the gas block housing. The carbon build up can cause the gas cylinder to become locked up, making rotation very difficult without frequent maintenance. In consideration of these and other deficiencies found in the prior art, a new manner of constructing and operating an adjustable gas block is needed.

SUMMARY OF THE INVENTION

Accordingly several objects and advantages of the present invention are (a) To provide a means for regulating the volume of gas diverted from the barrel to the indirect gas operating system of the host rifle.

(b) To provide a means to divert excess gas from the operating system without directly venting the gas into the atmosphere.

(c) To provide an adjustable gas block having multiple functional positions which can be actuated by the user without the need of tools.

(d) To provide a means of regulating the flow of gas into the operating system that does not rely on a rotatable gas cylinder in direct communication with the gas port of the barrel.

In accordance with one embodiment of the present invention, a firearm is provided comprising a receiver, an adjustable gas block for a gas operated rifle and an indirect gas operating system. The adjustable gas block is secured about the barrel such that the gas port of the barrel is in communication with the gas port of the gas block housing. In place of a rotatable gas cylinder, the adjustable gas block according to the present invention uses a fixed position gas nozzle which is in direct communication with the gas port of the barrel. The user is provided with an adjustment knob which allows for the selection of two distinct gas settings. The first position allows for a "standard" volume of gas to flow into the operating system. This position is optimized for rifle function when a noise suppressor is not being utilized. The second position, which is intended for use when a noise suppressor is being used, reduces the volume of gas which flows into the gas operating system by placing a channel and chamber located within the adjustment knob into communication with a secondary port located at the forward end of the gas nozzle. This secondary port vents a sufficient volume of excess gas from the adjustable gas block so that the firearm's operating system receives essentially the same volume of gas as it would in the absence of the noise suppressor. No tool is required to rotate the adjustment knob and select between the first and second positions.

Still further objects and advantages will become apparent from a consideration of the ensuing description and drawings.

DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended to define the limits of the invention.

DETAILED DESCRIPTION OF THE PREFERRED EMBODIMENT

The adjustable gas block for a gas operated firearm in accordance with the present invention is designed to provide two positions of adjustment, each of which regulates the flow of gas between the barrel gas port and the indirect gas operating system, or operating system, of the host firearm.

Figure 1:
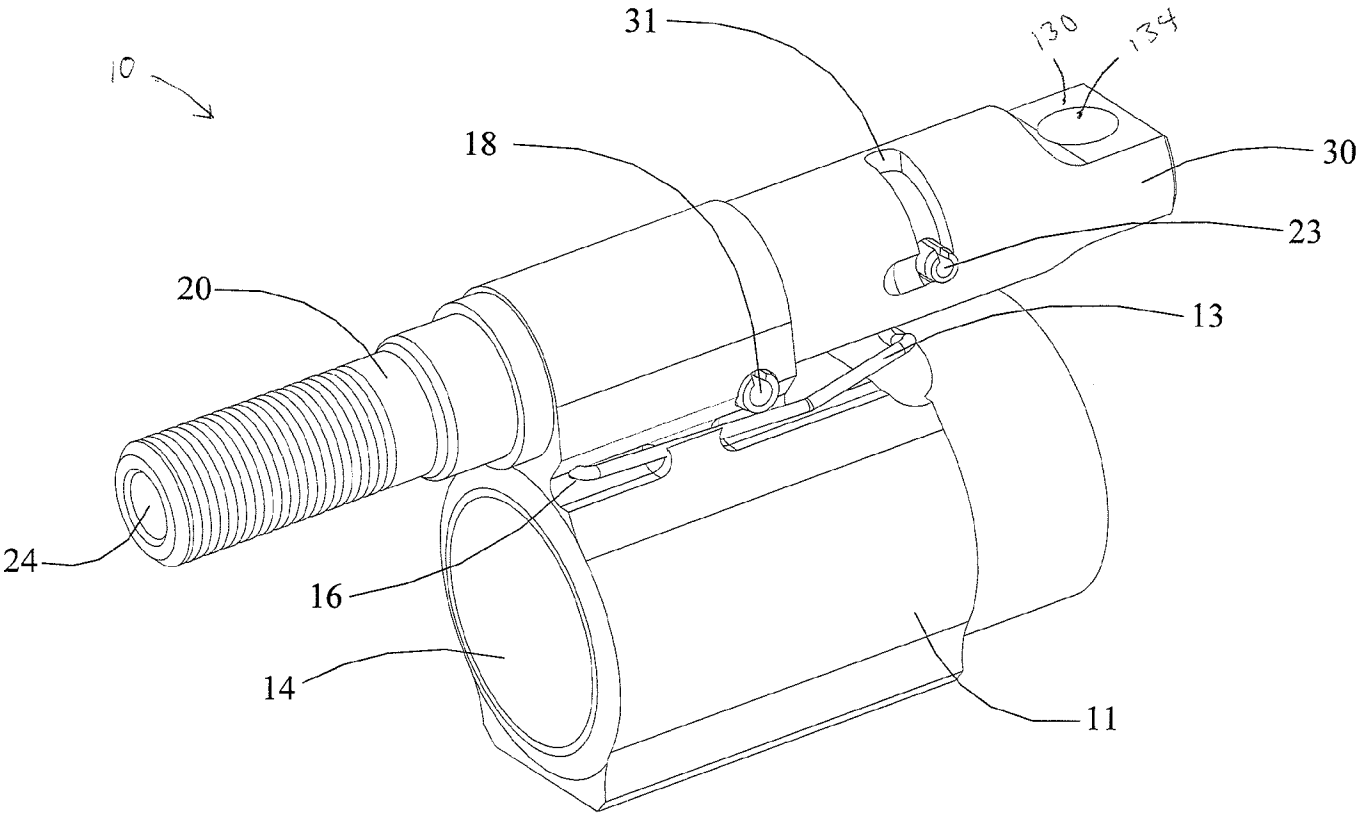
FIG. 1 is a side perspective view of an adjustable gas block for a gas operated firearm in accordance with the present invention.

Turning now to the drawings, in which like reference characters indicate corresponding elements throughout the several views, FIG. 1 shows an adjustable gas block, generally described by reference number 10, in accordance with the present invention. The adjustable gas block 10 is generally comprised of a housing 11, an adjustment knob 30, and a gas nozzle 20. In FIG. 1, the adjustment knob 30 is in the first position which provides an appropriate volume of gas for operating the host rifle 90, shown in FIGS. 5 and 9, when a back pressure generating device such as a noise suppressor or silencer is not being used.

As used herein, the word "front" or "forward" corresponds to the end of the adjustable gas block 10 where the adjustment knob 30 is located (i.e., to the right as shown in FIGS. 1-5); "rear" or "rearward" or "back" corresponds to the direction opposite the end of the adjustable gas block 10 where the adjustment knob 30 is located (i.e., to the left as shown in FIGS. 1-5).

Figure 2:
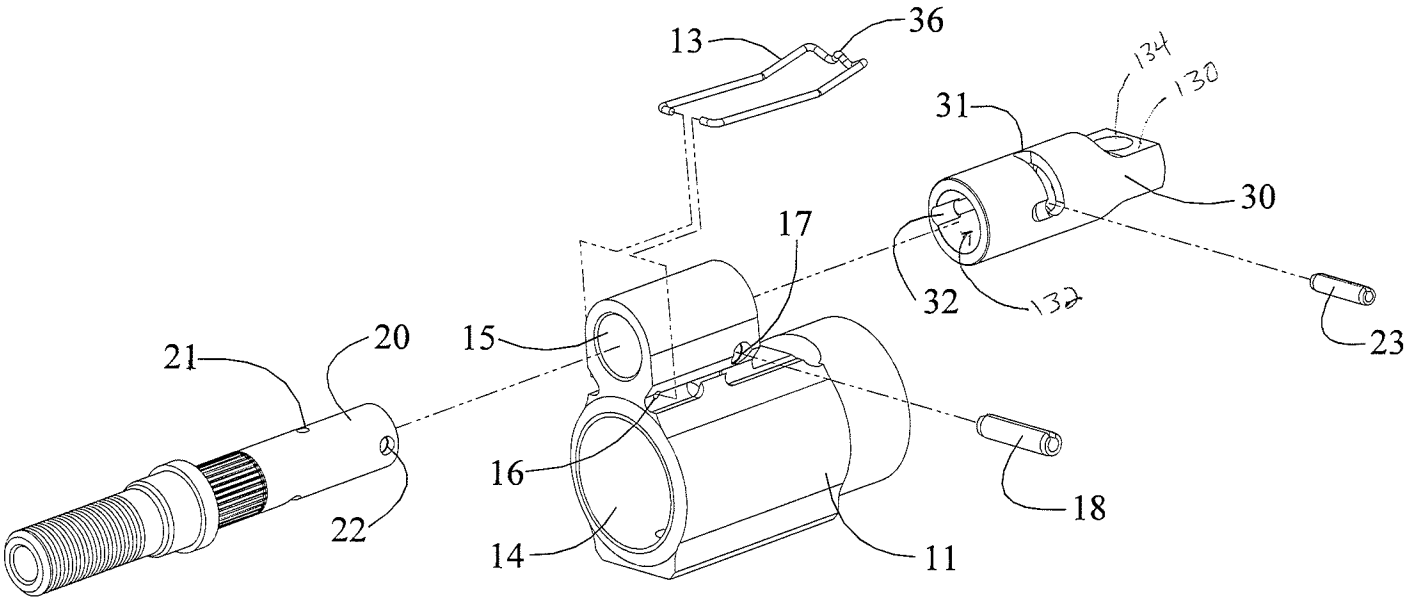
FIG. 2 is an exploded view of the adjustable gas block shown in FIG. 1.

FIG. 2 illustrates an exploded view of the gas block 10. The housing 11 has a barrel receiving channel 14 and a gas nozzle receiving channel 15, with the central axis of each being in vertical alignment with the other. A spring 13 is configured to fit onto the housing 11 and is held in place by placing its two ends into two openings 16 located at the rearward end of the housing 11, between the barrel receiving channel 14 and the gas nozzle receiving channel 15. An opening 17, which houses a roll pin 18, is located at the forward end of the gas nozzle receiving channel 15. The adjustment knob 30 has a slot 31 therein and the forward end of the gas nozzle 20 is provided with a side opening 22. When the gas nozzle 20 is received within the adjustment knob 30, the side opening 22 is aligned with the slot 31 and a roll pin 23 is inserted therethrough. On the exterior of the adjustment knob 30 are two notches 35A and 35B (see FIG. 8) which interface with the spring 13, shown in FIG. 2, thus preventing the unintentional rotation of the knob 30. The bottom side of the housing 11 has two tapered holes 12 which receive a pair of taper pins 19, shown in FIG. 6. The taper pins 19 prevent longitudinal and radial movement of the gas block housing 11 when it is mounted to the barrel 91.

The gas nozzle 20 has an axial bore 24 therethrough with two gas ports 26 and 27. The first gas port 26 is in direct communication with the gas port 25 of the housing 11 which, in turn, is in communication with the gas port 94 of the barrel 91 (see FIG. 6). The second gas port 27 is located at the forward end of the axial bore 24.

Figure 3:
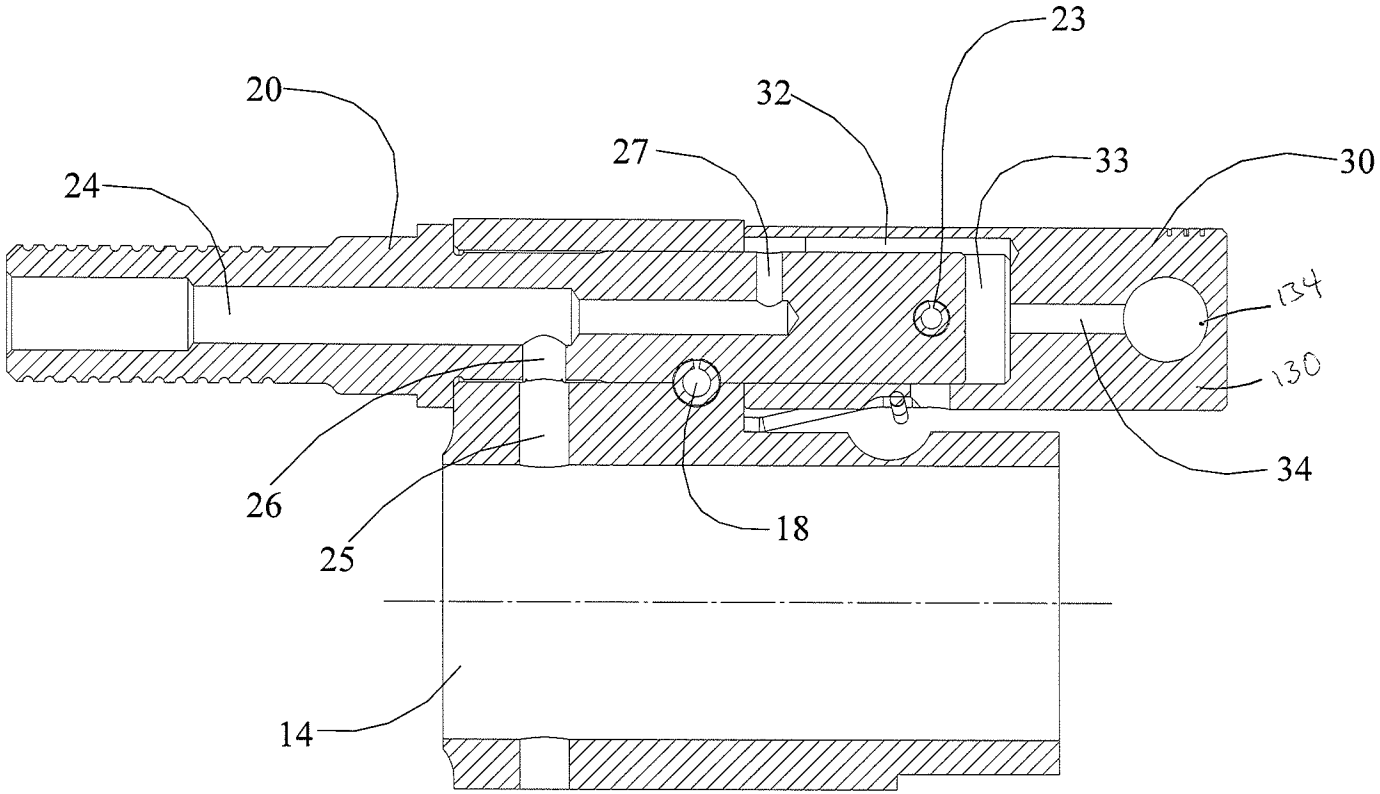
FIG. 3 is a side cutaway view of the adjustable gas block shown in FIG. 1.
Figure 4:
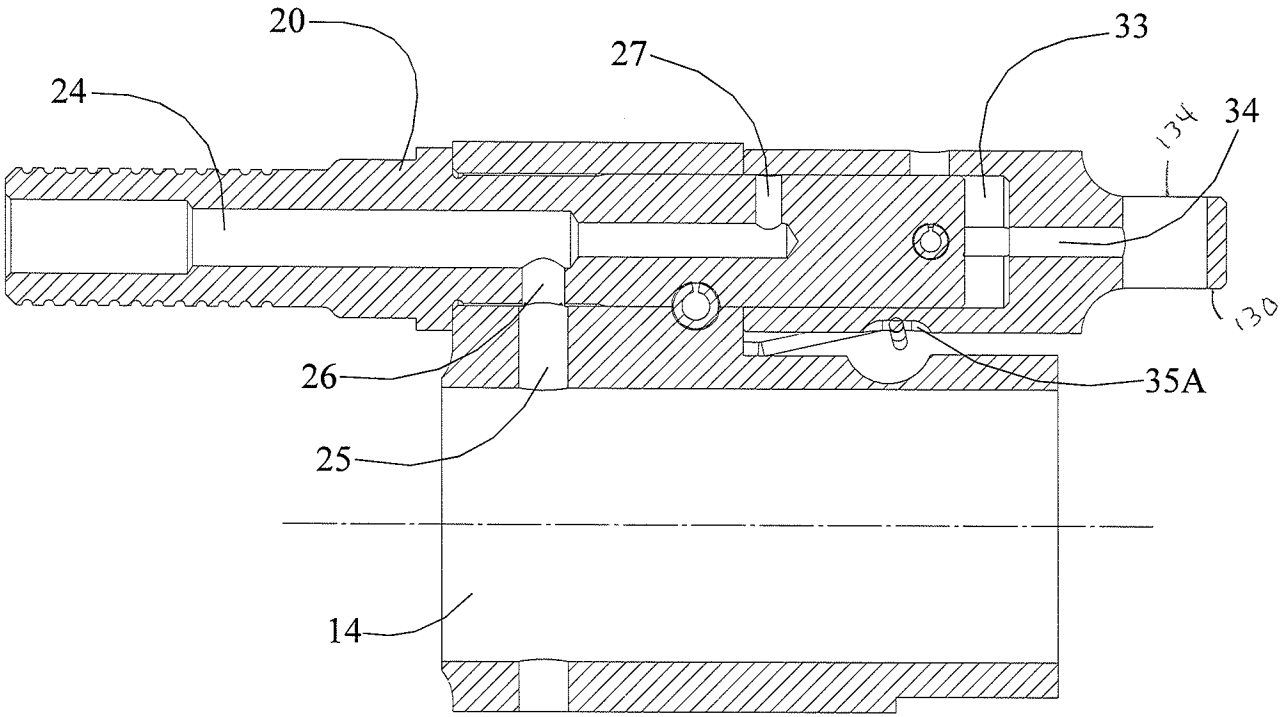
FIG. 4 is a side cutaway view of the adjustable gas block with the adjustment knob rotated 90° from the position shown in FIG. 3.

FIGS. 3 and 4 show side cutaway views of the adjustable gas block 10 of FIG. 1. The rear portion of the adjustment knob is substantially cylindrical with a central bore generally designated by reference numeral 132. A gas channel 32 is formed axially on the inner surface of the central bore. The gas channel is in communication with an expansion chamber 33 at the forward end of the bore 132. Further, the expansion chamber 33 is in communication with a centrally located opening 34 extending through the front portion of the adjustment knob 30.

The front portion of the adjustment knob 30 is contoured to have two opposing substantially flat sides. A through-opening 134 passing through the two sides 130 is in communication with the opening 34. By grasping the opposing sides with the thumb and at least one finger, the knob can be easily gripped by the user and manually rotated between the two predetermined positions of adjustment without the use of tools. In the first position of adjustment, shown in FIGS. 1, 2 and 4, the adjustment knob 30 is rotated so that the gas channel 32 is not in communication with the second gas port 27 located at the forward end of the gas nozzle 20. In the second position of adjustment, shown in FIGS. 3 and 5, the adjustment knob 30 is rotated so that the gas channel 32 of the adjustment knob 30 is in direct communication with the second gas port 27. According to the embodiment shown, the knob is rotated approximately 90° between the first and second positions. However, the gas block construction could be altered to require more or less rotation between the two positions.

Figure 5:
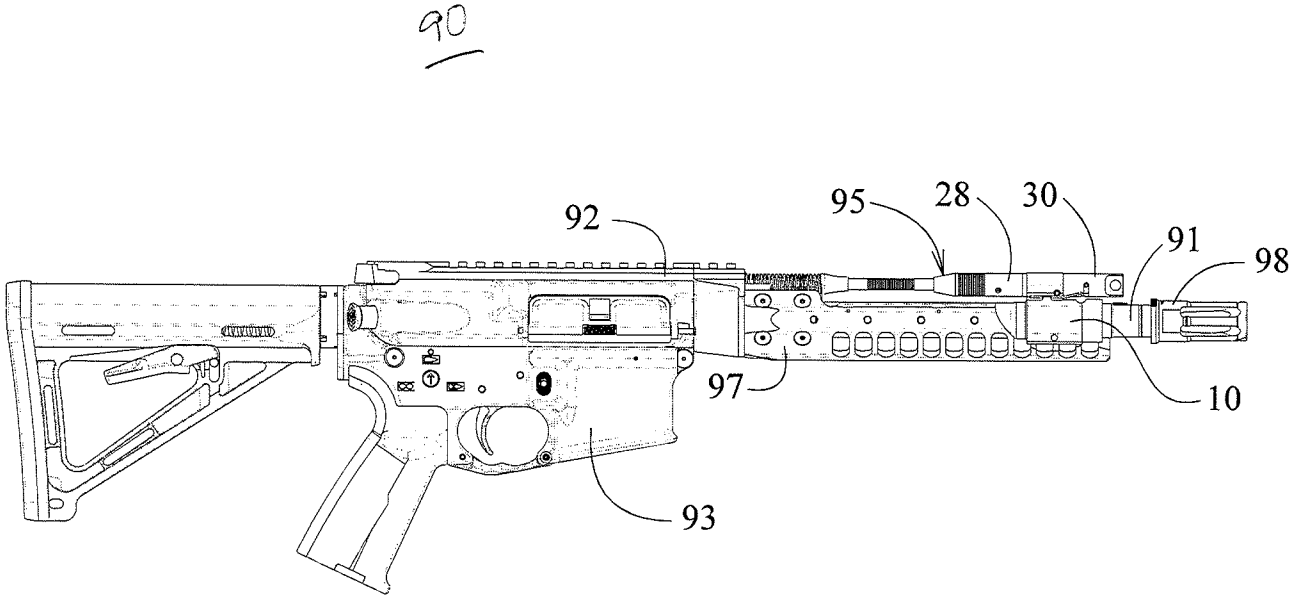
FIG. 5 is a side perspective view of a preferred embodiment rifle equipped with the adjustable gas block of FIG. 1 and having its gas operating system exposed.

FIG. 5 illustrates a side view of a preferred embodiment rifle 90. Shown is the lower receiver group 93 and the upper receiver group 92, both well known in the prior art. The barrel 91 has a handguard 97 which is shown with its top portion removed to expose the indirect gas operating system 95 of the rifle 90. Attached to the muzzle of the barrel 91 is a flash hider 98 which facilitates the mounting of a silencer 99 (see FIG. 9). The indirect gas operating system 95 used with the preferred embodiment is described in U.S. Pat. No. 7,461,581 ("the '581 patent"). The piston cup 28, which is a portion of the gas operating system 95, is nested over and around the rear portion of the gas nozzle 20. Also shown is the adjustable gas block 10 according to the present invention, with the adjustable gas block in its second position of adjustment.

Figure 6:
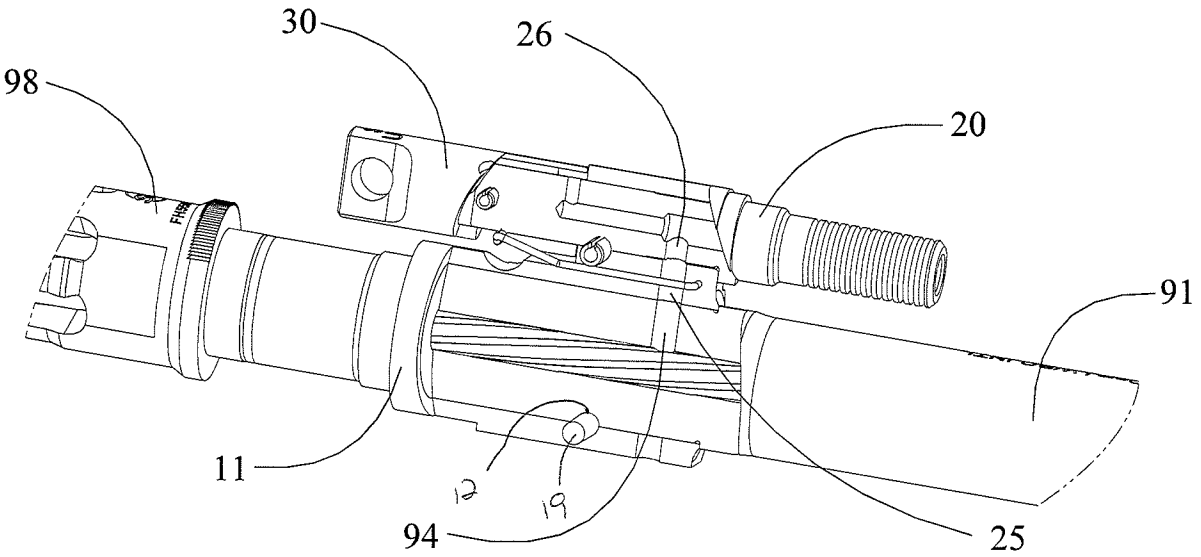
FIG. 6 is a side cutaway view of the adjustable gas block in accordance with the present invention mounted on a barrel.

FIG. 6 shows a cutaway view of the gas block housing 11 while mounted on the barrel 91. This illustration provides clarity for how the taper pins 19 interact with the barrel 91 to prevent movement of the housing 11 during routine use of the host rifle 90. Also shown is how the barrel gas port 94 is oriented in relation to the gas port 25 of the housing 11 and the gas port 26 of the gas nozzle 20.

Figure 7:
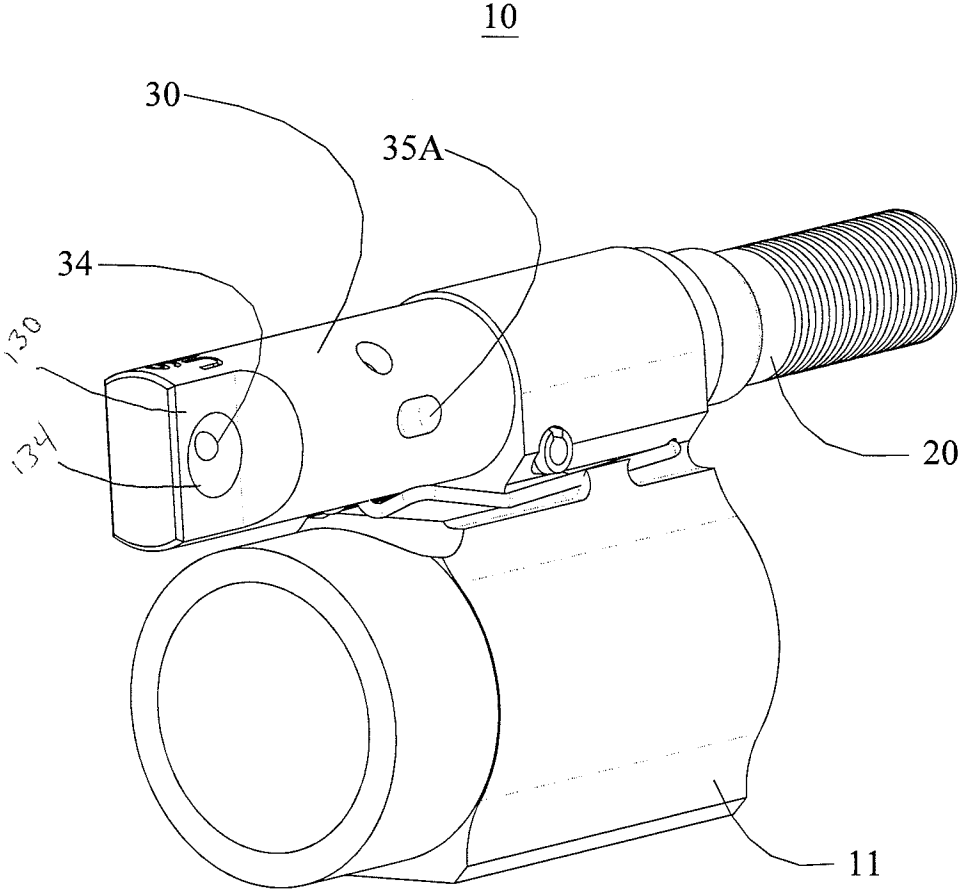
FIG. 7 is a front perspective view of the adjustable gas block shown in FIG. 1.

FIG. 7 illustrates a front perspective view of the adjustable gas block 10 and shows the opening 34 in the adjustment knob 30 for gas to exit the expansion chamber 33 when the adjustment knob has been rotated into the second position (see FIGS. 3 and 5). Also shown is one of the indexing notches 35A of the adjustment knob 30. This indexing notch 35A is only in operational contact with the spring 13 when the adjustment knob 30 is rotated to the first position of adjustment as shown in FIG. 4.

Figure 8:
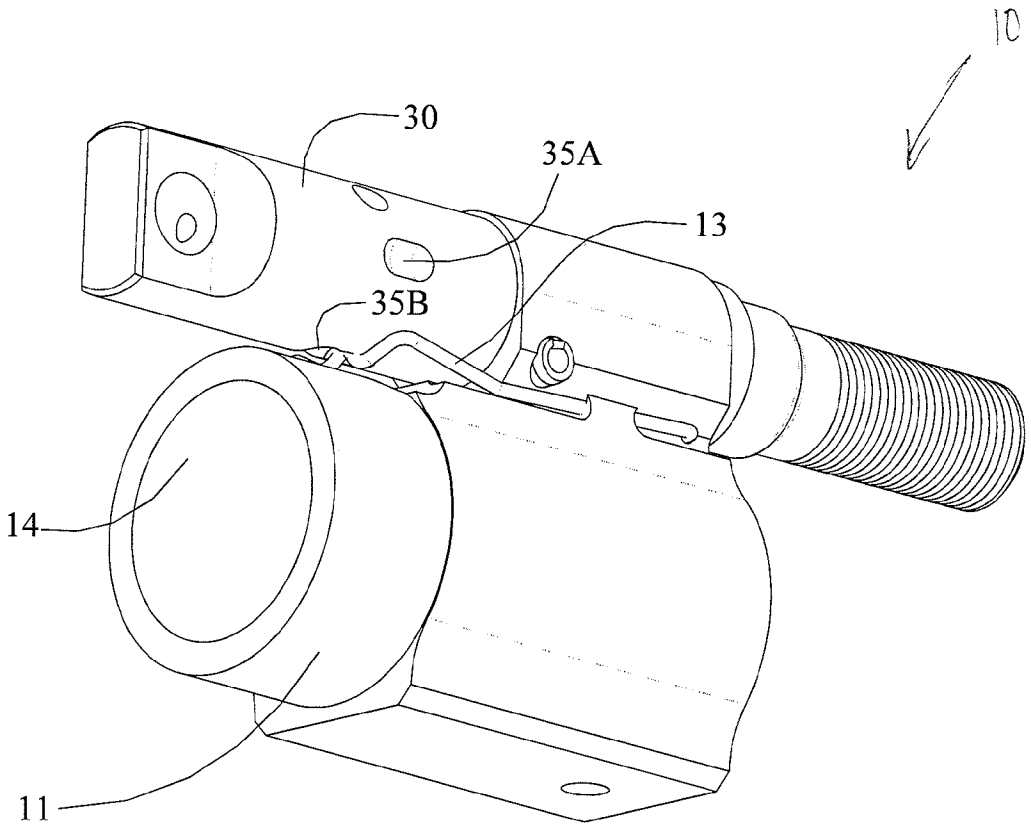
FIG. 8 is another perspective view of the adjustable gas block shown in FIG. 7.

FIG. 8 illustrates another front perspective view of the adjustable gas block 10. This view shows how the spring 13 interacts with the indexing notch 35B when the adjustment knob 30 is in the second position. The spring 13 has a bend 36 about its centerline; the bend 36, when nested in the indexing notch 35B as shown, prevents unintentional rotation of the adjustment knob 30.

Figure 9:
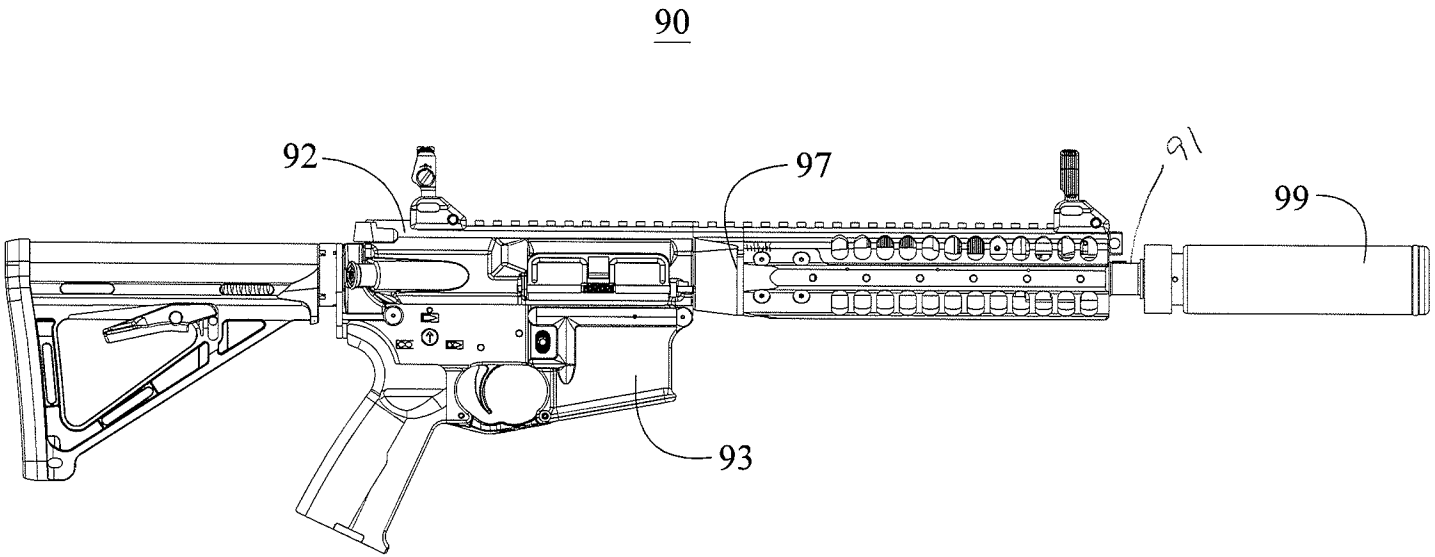
FIG. 9 is a side view of the preferred embodiment rifle shown in FIG. 5 with an attached silencer.

FIG. 9 illustrates a side perspective view of the preferred embodiment rifle 90 shown in FIG. 5 with a silencer 99 attached to the flash hider 98.

To assemble the adjustable gas block 10 according to the present invention, the housing 11 is slid over the barrel 91, with the barrel being received in the barrel receiving channel 14. The two tapered holes 12 of the housing 11 are aligned with two dimples (not shown) located on the underside of the barrel 91. Once aligned, the two taper pins 19 are inserted into the two tapered holes 12 to prevent rotational and longitudinal movement of the housing 11. The location of the two dimples is selected so that the gas port 94 of the barrel 91 is in alignment with both the gas port 25 of the housing and the gas port 26 of the gas nozzle 20, as best illustrated in FIG. 6.

The gas nozzle 20 is then inserted into the gas nozzle receiving channel 15 and retained in place by inserting the roll pin 18 through the opening 17 to prevent both longitudinal and rotational movement. The adjustment knob 30 is slid over the forward end of the gas nozzle 20 which protrudes out of the gas nozzle receiving channel 15. The roll pin 23 is inserted through the slot 31 in the adjustment knob 30 and through the opening 22 located at the forward end of the gas nozzle 20. The roll pin 23 prevents longitudinal movement while the slot 31 defines the limits of the rotational movement of the adjustment knob 30. The spring 13 is fitted into place between the adjustment knob 30 and the housing 11, being retained in place by its two ends which are secured into openings 16 located on both sides of the housing 11. The bend 36 of the spring 13 is shaped to removably fit into one of the two notches 35A and 35B located about the external surface of the adjustment knob 30. The piston cup 28 is then slid over the rearward end of the gas nozzle 20 with the remainder of the indirect gas operating system 95 being assembled as disclosed in the '581 patent.

The adjustable gas block, 10 when secured to a rifle 90 equipped with an indirect gas operating system 95 as disclosed herein, functions in the following manner. When the adjustment knob 30 is in the first position of adjustment and a round is discharged from the rifle 90, expanding gases which both precede and follow the projectile down the barrel are diverted through the gas port 94 of the barrel 91, through the gas port 25 of the housing 11 and finally into the first gas port 26 located near the forward end of the gas nozzle 20. As already disclosed, the first gas port 26 is in direct communication with the bore 24 in the gas nozzle 20. Once the gas enters the bore 24 it further expands therethrough and impinges on the piston cup 28 of the operating system 95, thereby reciprocating the action of the rifle 90, the details and specifics of which are not discussed herein. Gas is prevented from exiting through the second gas port 27 located at the forward end of the gas nozzle 20 by a portion of the adjustment knob's 30 internal side wall which blocks the second port 27. The first gas port 26, in direct communication with the gas port 94 of the barrel 91 through gas port 25, is calibrated to provide the optimal volume of gas for the reliable operation of the rifle 90 in the absence of a silencer 99 being attached to the muzzle of the barrel 91.

When the adjustment knob is rotated into its second position of adjustment (see FIGS. 3 *and* 5), the gas channel 32 is placed into communication with the second gas port 27 located at the forward end of the gas nozzle 20. While gas is expanding in the gas nozzle following the discharge of a loaded cartridge, as described above, a portion of the gas is ported through the second gas port 27, through the provided gas channel 32 and into the expansion chamber 33 formed between the exterior of the gas nozzle 20 and the interior of the adjustment knob 30. From the expansion chamber 33, the gas is released into the atmosphere through the opening 34 in the adjustment knob 30. Accordingly, the second position of the adjustable gas block 10 reduces the volume of gas which impinges on the piston cup 28 by releasing a portion of the expanding gases through the second gas port 27. This is desirable when a silencer 99 is mounted to the flash hider 98 as shown in FIG. 9, because the silencer 99 increases the volume of expanding gases, or back pressure, forced through the gas port 25 into the gas nozzle 20. The second gas port 27 at the forward end of the gas nozzle 20 reduces the volume of gas directed to the operating system 95 by diverting and venting a portion of it as described above. Through such venting, the volume of expanding gases which comes into contact with the piston cup 28 is approximately that which is desired to operate the rifle in the absence of a silencer 99 being affixed to the muzzle of the barrel 91. In addition, venting a portion of the operating gases from the gas block housing serves to minimize fouling, reduce recoil and reduce premature wear of the host firearm when a silencer is in use.

Still another embodiment of the adjustable gas block could be adapted to work with a direct gas impingement system such as found on M16 style rifles. The nozzle assembly can be modified to receive the prior art gas tube found on such systems, or even a non-standard straight profile gas tube, and thereby regulate the flow of gas between the barrel and the firearm's operating system.

While the above drawings and description contain much specificity with respect to certain of the features of the present invention, these should not be construed as limitations on the scope of the invention, but rather as an exemplification of one preferred embodiment thereof.

It is now apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

The invention claimed is:

1. A gas operated firearm comprising:

a receiver;

a barrel having a gas port, and being attached to the receiver;

a gas operating system;

an adjustable gas block including, a housing having a barrel receiving channel for receiving a portion of the barrel therein and a gas nozzle receiving channel for receiving a portion of a gas nozzle therein;

a gas nozzle having a bore which is in gas flow communication with said gas operating system and at least a first port and a second port, a front end of said gas nozzle being inserted into said gas nozzle receiving channel, and said first port being in operational communication with the gas port of said barrel; and an adjustment knob having a central bore which receives the front end of said gas nozzle and is configured to be secured thereto, said adjustment knob configured to be manually rotated by a user between a first position and a second position to regulate an amount of gas which exits said gas nozzle into said gas operating system according to whether or not a back pressure increasing device is attached to the barrel, and wherein an inner wall of said central bore has a gas channel formed therein, said gas channel being out of communication with said second port when said knob is in said first position and said gas channel being in communication with said second port when said knob is in said second position.

2. The gas operated firearm as set forth in claim 1, wherein said adjustable gas block has an expansion chamber in communication with said gas channel, said expansion chamber being formed at a front end of said central bore, rotation of said adjustment knob into said second position placing said gas nozzle into communication with said expansion chamber.

3. The gas operated firearm as set forth in claim 2, wherein said expansion chamber is in communication with a through opening in said adjustment knob to allow expanding gases to exit said adjustment knob when said adjustment knob is in said second position.

4. The gas operated firearm as set forth in claim 1, wherein in said first position of said adjustment knob, said second port is blocked by the inner wall of said central bore.

5. A gas operated firearm comprising:

a receiver;

a barrel connected to the front of the receiver, said barrel including a gas port;

a gas operating system in communication with the receiver;

an adjustable gas block removably attached to the barrel, said gas block including a housing, a gas nozzle partly received in said housing and an adjustment knob;

said housing of the adjustable gas block including a gas port in communication with the gas port of said barrel;

an expansion chamber being formed between the exterior of the gas nozzle and the interior of the adjustment knob;

said adjustment knob having a central bore receiving a portion of the gas nozzle, said central bore having a channel defined on its interior surface, said channel being in communication with said expansion chamber;

said gas nozzle having a bore and at least two ports in communication with said bore, said adjustment knob being rotatable and having an indexing feature to locate the channel in a plurality of predefined positions, the first port being blocked to prevent gas from flowing from the gas nozzle into the expansion chamber when said adjustment knob is in a first predefined position; and a portion of the gas nozzle being received by and in communication with the gas operating system.

6. The gas operated firearm as set forth in claim 5, wherein the adjustment knob includes a gas exit opening which is in communication with said expansion chamber.

7. The gas operated firearm as set forth in claim 5, wherein the plurality of predefined positions includes a second predefined position that places the first port of the gas nozzle in communication with the expansion chamber through said channel in the adjustment knob central bore.

8. The gas operated firearm as set forth in claim 7, wherein the first predefined position that blocks the flow of gas into said expansion chamber allows a volume of gas needed to properly operate the gas operated firearm to flow to the gas operating system when a back pressure increasing device is not attached to the barrel.

9. The gas operated firearm as set forth in claim 7, wherein said channel formed in the interior surface of the central bore is sized to permit venting of an excess volume of gas produced when a back pressure inducing device is secured to the barrel so that only a volume of gas necessary to properly operate the gas operated firearm when a back pressure inducing device is not affixed to the barrel is provided to the gas operating system.

10. The gas operated firearm as set forth in claim 9, wherein the back pressure increasing device is a silencer.

11. An adjustable gas block for use with a firearm having a gas operating system and a barrel with a gas port, said adjustable gas block comprising:

a housing having a barrel receiving channel for receiving a portion of the barrel therein and a gas nozzle receiving channel for receiving a portion of a gas nozzle therein;

a gas nozzle having a bore which is in gas flow communication with said gas operating system and at least a first port and a second port, a front end of said gas nozzle being inserted into said gas nozzle receiving channel, and said first port being in operational communication with the gas port of said barrel; and an adjustment knob having a central bore which receives the front end of said gas nozzle and is configured to be secured thereto, said adjustment knob configured to be manually rotated by a user between a first position and a second position to regulate an amount of gas which exits said gas nozzle into said gas operating system according to whether or not a back pressure increasing device is attached to the barrel, and wherein an inner wall of said central bore has a gas channel formed therein, said gas channel being out of communication with said second port when said knob is in said first position and said gas channel being in communication with said second port when said knob is in said second position.

12. The adjustable gas block as set forth in claim 11, wherein said adjustable gas block has an expansion chamber in communication with said gas channel, said expansion chamber being formed at a front end of said central bore, rotation of said adjustment knob into said second position placing said gas nozzle into communication with said expansion chamber.

13. The adjustable gas block as set forth in claim 12, wherein said expansion chamber is in communication with a through opening in said adjustment knob to allow expanding gases to exit said adjustment knob when said adjustment knob is in said second position.

14. The adjustable gas block as set forth in claim 11, wherein in said first position of said knob, said second port is blocked by the inner wall of said central bore.

* * * * *